United States Patent [19]

Leivenzon et al.

[11] 4,182,144

[45] Jan. 8, 1980

[54] DOOR HANDLE LOCK AND LATCH MECHANISM FOR CORRUGATED ROLLER DOORS

[75] Inventors: Simon Leivenzon; Steven Leivenzon, both of Caulfield, Australia

[73] Assignee: Firmaframe Nominees Proprietary Ltd., Victoria, Australia

[21] Appl. No.: 907,416

[22] Filed: May 18, 1978

[51] Int. Cl.[2] ..... E05B 5/00; E05B 9/08; E05B 65/00; E06B 9/20

[52] U.S. Cl. ..... 70/100; 70/448; 70/451; 292/36; 292/139; 292/336.3; 292/337; 292/DIG. 46; 292/DIG. 53

[58] Field of Search ..... 70/100, 118, 448, 451, 70/DIG. 11, 113, 114, 116, 118, 120, 121, 123; 160/201, 133, 232, 235; 292/34, 33, 36-39, 139, 52, 167, 336.3, 337, DIG. 53, DIG. 46

[56] References Cited

U.S. PATENT DOCUMENTS

| | | | |
|---|---|---|---|
| 780,181 | 1/1905 | Holden | 292/52 |
| 1,067,547 | 7/1913 | Posson | 292/DIG. 46 |
| 1,587,939 | 6/1926 | Claveria | 70/100 |
| 2,825,219 | 3/1958 | Marzillier | 292/336.3 X |
| 3,104,699 | 9/1963 | Wolf et al. | 160/232 X |
| 3,119,474 | 1/1964 | Grossman | 292/39 X |
| 3,149,381 | 9/1964 | Santo | 292/36 X |
| 3,415,304 | 12/1968 | Sawyer | 160/235 |
| 3,683,652 | 8/1972 | Halopoff et al. | 292/DIG. 36 |
| 3,809,415 | 5/1974 | Westcott | 292/337 X |

FOREIGN PATENT DOCUMENTS

| | | | |
|---|---|---|---|
| 253814 | 8/1964 | Australia | 70/100 |
| 186547 | 8/1956 | Austria | 292/34 |
| 701083 | 1/1965 | Canada | 160/133 |
| 589975 | 6/1925 | France | 70/100 |

*Primary Examiner*—Mervin Stein
*Assistant Examiner*—Carl F. Pietruszka
*Attorney, Agent, or Firm*—Larson, Taylor and Hinds

[57] ABSTRACT

The present invention relates to a door handle lock and latch mechanism for a corrugated roller shutter door wherein the door handle is situated some distance up from the bottom of the door.

The door handle and lock is situated in a corrugation which is open to the front face of the door and the latch mechanism is located in an adjacent corrugation(s) open to the rear face of the door. The latch mechanism attaches to the lock mechanism through an opening in either or both of the top or bottom wall of the corrugation in which the lock is situated.

9 Claims, 8 Drawing Figures

DOOR HANDLE LOCK AND LATCH MECHANISM FOR CORRUGATED ROLLER DOORS

FIELD OF THE INVENTION

This invention relates to an improved door handle lock and latch mechanism combination for a corrugated roller door of the type which rolls up onto a drum.

DESCRIPTION OF PRIOR ART

Hitherto there have been many proposals for door handles and locks for roller doors of the above type and in such proposals particular attention has been made to a construction which is relatively thin such that when the door is rolled up, the thickness of the door handle lock and latch mechanism combination does not unduly influence the rolling of the door over the door roller. It will be appreciated that such problems only arise when the door handle lock and latch mechanism combination is situated some distance up from the bottom extremity of the door.

In Australian Pat. No. 253,814 dated 24th Oct. 1960, in the name of Roll-A-Door Proprietary Limited which is exemplary of the previous state of the art so far it has developed prior to the present invention, there is shown a door handle lock and latch mechanism which is relatively thin. Such construction has the draw back that the front handle portion protrudes unduly from the front face of the door, particuarly when a lifting handle is incorporated therewith. This not only makes for unsightly appearance but has the effect of scuffing the rear face of the door on an adjacent layer when the door is rolled up.

SUMMARY OF THE INVENTION.

It is a principle object of the present invention to provide an improved door handle lock and latch mechanism combination which does not protrude unduly from the front face of the door and which at the same time can have pleasing appearance when viewed from the front of the door.

According to the present invention there is provided a door handle, lock and latch mechanism combination for a corrugated roller door comprising, a handle portion shaped to closely fit in a corrugation of the door which is open at the front face and extends inwardly towards the rear face of the door, said handle portion being of a size not to project unduly from the front face of the door, a lock in the handle portion and being of a size not to project unduly from the front face of the handle portion, and latch bar means for fitting in a corrugation adjacent the corrugation in the front face of the door in which the handle portion is fittable and to connect with said lock through opening means in either the top or bottom walls of the corrugation in which the handle portion is fittable, the latch bar means being movable by operation of the lock to a position inwardly of the side of the door to allow the door to be openable and to a position where it extends outwardly of the side of the door to engage with latch engaging means associated with the door frame of the door whereby to lock the door with respect to the door frame.

DESCRIPTION OF PREFERRED EMBODIMENT

Figure 1:
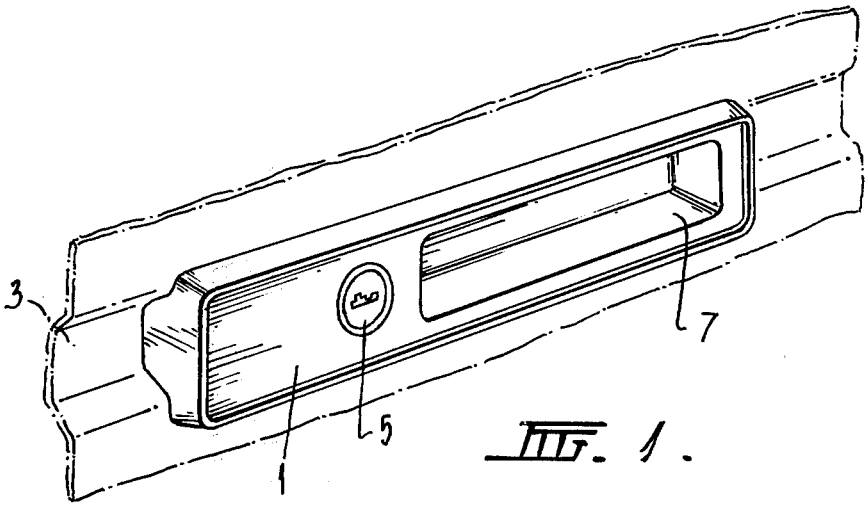
FIG. 1 is a front perspective view of the assembly.
Figure 2:
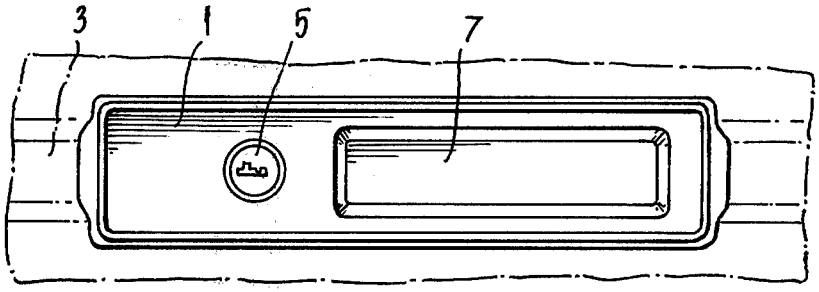
FIG. 2 is a front view of the assembly.
Figure 3:
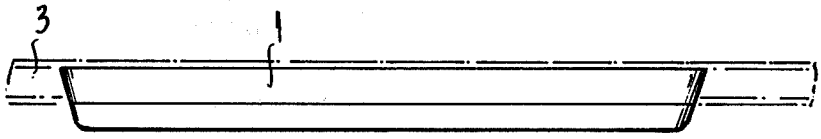
FIG. 3 is a top plan view of the assembly.
Figure 4:
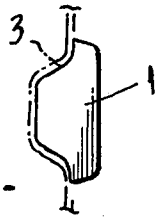
FIG. 4 is an end view of the assembly.
Figure 5:
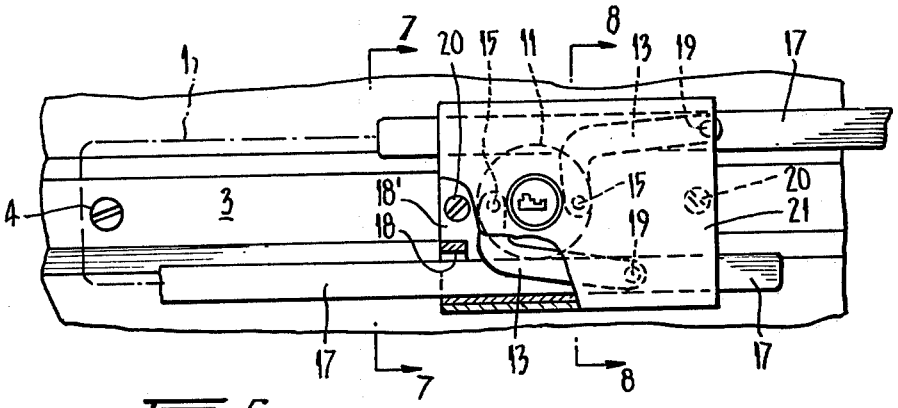
FIG. 5 is a rear view of the assembly showing the locking bars in the door locked position.
Figure 6:
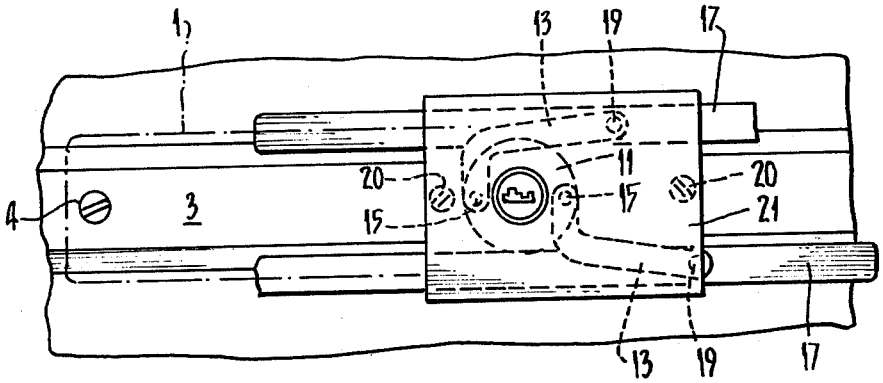
FIG. 6 is a rear view similar to FIG. 5 but showing the locking bars in the door unlocked position.
Figure 7:
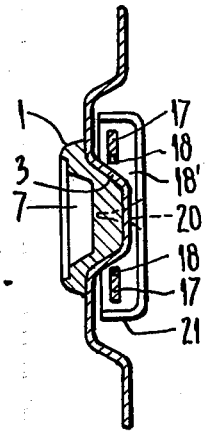
FIG. 7 is an end view along line 7—7 of FIG. 5.
Figure 8:
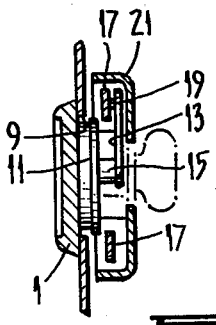
FIG. 8 is an end sectional view aong line 8—8 of FIG. 5.

The assembly comprises a handle portion 1 mounted to closely fit in the front face of the door in a transverse corrugation 3 therein so as not to protrude unduly therefrom. The corrugation 3 is of known configuration for roller shutter doors. The handle portion 1 is held to the door by screws 4 (see FIGS. 5 and 6). The handle portion 1 contains a lock 5 and a recessed handle 7 for the door extends rearwardly thereinto. The lock 5 is of known form and protrudes through the back face of the door through an opening 9 therein (see FIG. 8). The rear end of the lock 5 has a disc 11 integrally attached thereto so that when the lock barrel is rotated the disc 11 rotates therewith. Attached to the disc 11 are two arms 13. The arms 13 connect with the disc 11 by lugs 15 which extend from the disc 11, and these arms 13 are, in turn, fastened to locking bars 17 by similar lugs 19 on the locking bar 17. It will be noted from viewing FIGS. 5 and 6 that when the barrel of the lock 5 is rotated the bars 17 are either extended or retracted from the respective sides of the door, the upper bar 17 extending outwardly of the door to the right and the lower bar 17 outwardly to the left. To lock the door the barrel of the lock 5 is rotated so that the bars 17 are moved to the position shown in FIG. 5 so that the bars 17 can locate in suitable openings in the door frame.

The bars 17 are guided in the corrugations 3 in the rear face of the door by openings 18 in each end of a plate member 18' which is secured to the door by screws 20 which pass into the housing 1.

A cover plate 21 covers the arms 13 so that they are not visible from the rear of the door.

The lock 5 has a key opening from the rear face into which a key for the lock can be inserted to open the door from the rear is desired.

It will be noted that the preferred assembly provides for a relatively thin handle lock and latch bar mechanism so that when the corrugated door is rolled up the thickness thereof does not unduly cause problems.

Modification may be made to the invention as would be apparent to those skilled in the art and such modifications are deemed to be within the scope thereof.

We claim:

1. A door handle, lock and latch mechanism combination for a corrugated roller door comprising, a handle portion shaped to closely fit in a corrugation of the door which is open at the front face and extends inwardly towards the rear face of the door, said handle portion being of a size not to project unduly from the front face of the door, a lock in the handle portion and being of a size not to project unduly from the front face of the handle portion, and latch bar means for fitting in the rearwardly open corrugation adjacent said corrugation in the front face of the door in which the handle portion is fittable and to connect with said lock through opening means in either the top or bottom walls of said corrugation in which the handle portion is fittable, the latch bar means being movable by operation of the lock to a position inwardly of the sides of the door to allow the door to be openable and to a position where it extends outwardly of the side of the door to engage with latch engaging means associated with the door frame of the door whereby to lock the door with respect to the door frame.

2. A door handle, lock and latch mechanism combination as claimed in claim 1 wherein the lock is a barrel lock, the axis of rotation being aligned to be perpendicular to the plane of the front face of the door.

3. A door handle, lock and latch mechanism combination as claimed in claim 2 wherein there is a disc mounted co-axial with the axis of rotation of the barrel on the rear end of the lock and arranged to rotate with said barrel and wherein the latch bar means connects with said disc via, an arm member, pivotally attached to the disc and the latch bar means.

4. A door handle, lock and latch mechanism combination as claimed in claim 1 fitted in a corrugated roller shutter door.

5. A door handle, lock and latch mechanism combination for a corrugated roller door comprising, a handle portion shaped to closely fit in a corrugation of the door which is open at the front face and extends inwardly towards the rear face of the door, said handle portion being of a size not to project unduly from the front face of the door, a lock in the handle portion and being of a size not to project unduly from the front face of the handle portion, and two latch bars for fitting respectively in the rearwardly open corrugations adjacent said corrugation in the front face of the door in which the handle portion if fittable and to connect with said lock through openings in the top and bottom walls of said corrugation in which the handle portion if fittable, the latch bars being movable by operation of the lock to a position inwardly of the sides of the door to allow the door to be openable and to a position where they extend outwardly of the sides of the door to engage with latch engaging means associates with the door frame of the door whereby to lock the door with respect to the door frame.

6. A door handle, lock and latch mechanism combination as claimed in claim 5 wherein the lock is a barrel lock, the axis of rotation being aligned to be perpendicular to the plane of the front face of the door.

7. A door handle, lock and latch mechanism combination as claimed in claim 6 wherein there is a disc mounted co-axial with the axis of rotation of the barrel on the rear end of the lock and arranged to rotate with said barrel and wherein the latch bars connect with said disc on diametrically opposite sides thereof and wherein each latch bar means connects with the disc via, an arm member, pivotally attached to the disc on the latch bar means.

8. A door handle, lock and latch mechanism combination as claimed in claim 6 fitted in a corrugated roller shutter door.

9. A door handle, lock and latch mechanism combination fitted in a corrugated roller door comprising, a handle portion shaped to closely fit in a corrugation of the door which is open at the front face and extends inwardly towards the rear face of the door, said handle portion being of a size not to project unduly fron the front face of the door, a lock in the handle portion and being of a size not to project unduly from the front face of the handle portion, and two latch bars for fitting respectively in the readwardly facing corrugations adjacent said corrugation in the front face of the door in which the handle portion is fittable and to connect with said lock through openings in the top and bottom walls of said corrugation in which the handle portion is fittable, the latch bars being movable by operation of the lock to a position inwardly of the sides of the door to allow the door to be openable and to a position where they extend outwardly of the sides of the door to engage with latch engaging means associated with the door frame of the door whereby to lock the door with respect to the door frame and wherein the lock is a barrel lock, the axis of rotation being aligned to be perpendicular to the plane of the front face of the door, and wherein there is a disc mounted co-axial with the axis of rotation of the barrel on the rear end of the lock and arranged to rotate with said barrel and wherein the latch bars connect with said disc on diametrically opposite sides thereof, and wherein the latch bar means connects with the disc via, an arm member, pivotally attached to the disc and the latch bar means.

* * * * *